US006873318B1

(12) United States Patent
Wong

(10) Patent No.: US 6,873,318 B1
(45) Date of Patent: Mar. 29, 2005

(54) METHOD AND APPARATUS FOR ADDRESSING BEAT PATTERNS IN AN INTEGRATED VIDEO DISPLAY SYSTEM

(75) Inventor: Hee Wong, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 440 days.

(21) Appl. No.: 09/864,561

(22) Filed: May 23, 2001

(51) Int. Cl.[7] ..... G09G 5/00
(52) U.S. Cl. ..... 345/204; 345/213
(58) Field of Search ..... 345/98, 99, 204, 345/211, 213, 205, 212; 348/739

(56) References Cited

U.S. PATENT DOCUMENTS

| | | | | | |
|---|---|---|---|---|---|
| 4,336,558 | A | | 6/1982 | Lew | 358/285 |
| 5,196,839 | A | * | 3/1993 | Johary et al. | 345/691 |
| 5,280,352 | A | | 1/1994 | Herrmann | 358/160 |
| 5,287,100 | A | * | 2/1994 | Guttag et al. | 345/213 |
| 5,444,407 | A | | 8/1995 | Ganapathy et al. | 327/295 |
| 5,475,402 | A | * | 12/1995 | Hijikata | 345/211 |
| 5,982,453 | A | | 11/1999 | Willis | 348/607 |
| 6,002,449 | A | | 12/1999 | Tsyrganovich | 348/725 |
| 6,005,557 | A | * | 12/1999 | Wong | 345/204 |
| 6,020,939 | A | * | 2/2000 | Rindal et al. | 348/805 |
| 6,097,379 | A | * | 8/2000 | Ichiraku | 345/213 |
| 6,130,660 | A | * | 10/2000 | Imsand | 345/698 |
| 6,486,612 | B2 | * | 11/2002 | Fujimura et al. | 315/225 |
| 2002/0036723 | A1 | * | 3/2002 | Ishii et al. | 348/807 |

* cited by examiner

*Primary Examiner*—Regina Liang
(74) *Attorney, Agent, or Firm*—Darby & Darby P.C.; John W. Branch

(57) ABSTRACT

Disclosed is a video data re-clocking scheme for use in highly integrated system circuits to overcome the problem of beat patterns. These type of circuits contain many subsystem blocks, and each of those blocks may use different clock frequencies. Due to implementation constraints, clock interferences from nearby blocks are unavoidable. In a video display sub-system, these interferences produce beat patterns that substantially degrade video quality. One disclosed embodiment of the invention employs re-clocking flips-flops to re-time the input signals feeding the video Red/Green/Blue Digital-to-Analog converters (RGB DACs) such that data edge jitters due to interference are removed. The resulting picture quality is free of beat patterns.

19 Claims, 2 Drawing Sheets

Data Re-Clocking Scheme for Eliminating Video Beat Patterns

Data Re-Clocking Scheme for Eliminating Video Beat Patterns

Alternative Data Re-Clocking Scheme

METHOD AND APPARATUS FOR ADDRESSING BEAT PATTERNS IN AN INTEGRATED VIDEO DISPLAY SYSTEM

FIELD OF THE INVENTION

The present invention relates to the field of digital circuits, and in particular, to integrated video display circuits.

BACKGROUND OF THE INVENTION

Many video display systems show beat patterns when the video data contains specific display patterns. These beat patterns show up on a display as bands, streaks, or other forms. The beat pattern frequencies are not normally an integer multiple of half of the video horizontal scanning frequency, and hence the beat patterns tend to manifest themselves as moving patterns. Until now, it has not been known exactly what caused the beat patterns, and very little was known about how to eliminate them.

Existing attempts to address beat patterns typically seek to alter or tune the frequencies of the particular subsystems to minimize the symptoms of the beat patterns. For instance, one method sometimes used is to force the frequency of the beat pattern to some relationship of the horizontal and vertical scanning frequencies so that the pattern is non-moving. This method does not eliminate the beat pattern but rather hides it from the human eye. This method takes advantage of the fact that the human eye cannot easily detect non-moving objects, especially objects with fuzzy outlines. However, even if the beat pattern is not moving and nearly invisible to the human eye, the diminished video quality is still present.

Another method sometimes used is the canceling method. With this method, inverted beat pattern attributes (such as intensity) are introduced on consecutive horizontal scan lines so the pattern seems to "cancel out" its appearance.

Still another method sometimes used is the resizing method. With this method, one or more of the system frequencies is changed such that the physical size of the interfacing bands is ether very small or very large to the viewer. If the beat frequency were set to a much higher frequency than the horizontal scanning frequency, then the "bands" would become tiny, and hence less visible to the viewer. Similarly, if the beat frequency were set sufficiently low (e.g., 0Hz), then only one band with uniform intensity would appear on the screen. From the viewer's perspective, the interfering patterns would no longer exist.

Yet another method sometimes used is the blurring method. This technique involves sweeping one or more of the system frequencies in a pseudo random manner. This technique results in a blurred beat pattern which is less visible to the viewer.

Unfortunately, these existing attempts to solve the beat pattern problem are inadequate because they do not address the problem but rather only try to mask its symptoms. The result of each of these methods is merely a beat pattern which may be less visible to the viewer, but which still results in diminished video quality. Accordingly, both the actual problem causing beat patterns and an acceptable solution to that problem have eluded those skilled in the art.

SUMMARY OF THE INVENTION

The present invention overcomes the problems identified above by identifying that beat patterns are the modulation results of one or more interfering frequencies mixing with the video pixel frequency in a video display system. To address the problem, a method of "Cleaning-up Afterwords" is used. Using a "clean" local pixel clock to re-clock the final stage of the video data path to the RGB DACs eliminates the beat patterns. In one embodiments, re-clocking flip-flops are used to re-time a video data signal feeding a video Red/Green/Blue Digital-to-Analog converters (RGB DACs) such that data edge jitters due to interference are removed. The resulting picture quality is free of beat patterns. This method also allows more design freedom, such as higher jitter tolerance budget for the entire clock distribution system and increased distance between the video data source and the RGB DACs.

A more complete appreciation of the present invention and its improvements can be obtained by reference to the accompanying drawings, which are briefly summarized below, to the following detail description of presently preferred embodiments of the invention, and to the appended claims.

DETAILED DESCRIPTION OF THE PREFERRED EMBODIMENT

Figure 1:
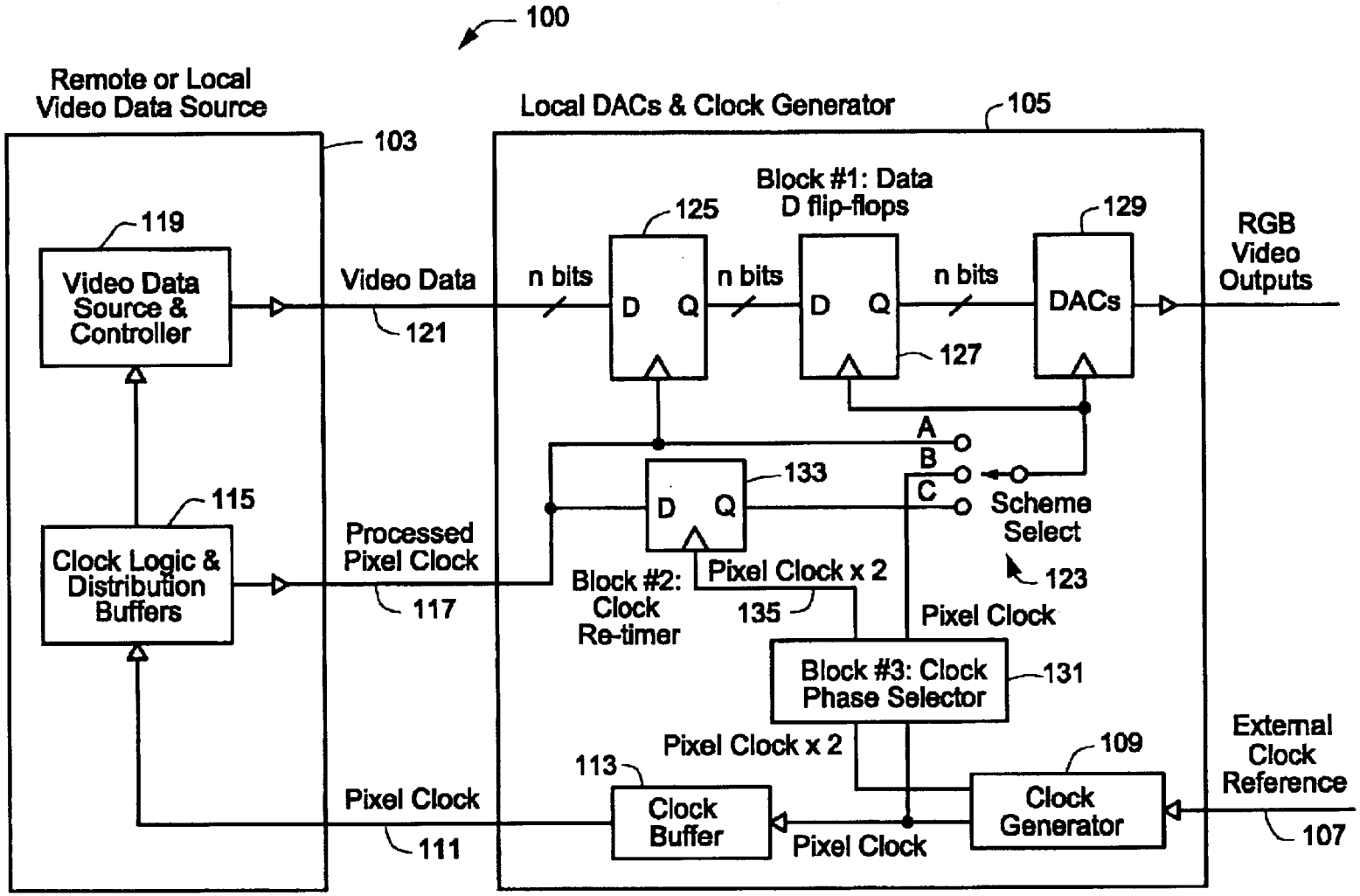
FIG. 1 illustrates a schematic diagram of an electronic circuit with a re-clocking circuit with improved beat pattern characteristics.

In the following detailed description of exemplary embodiments of the invention, reference is made to the accompanying drawings, in which is illustrated specific exemplary implementations of the invention. These implementations are described in sufficient detail to enable those skilled in the art to practice the invention, and it is to be understood that other implementations may be utilized, and other changes may be made, without departing from the spirit or scope of the present invention. The following detailed description is, therefore, not to be taken in a limiting sense, and the scope of the present invention is defined only by the appended claims.

Throughout the specification and in the claims, the term "connected" means a direct electrical connection between the things that are connected, without any intermediate devices. The term "coupled" means either a direct electrical connection between the things that are connected, or an indirect connection through one or more passive or active intermediary devices. The term "circuit" means one or more components, either active or passive, that are coupled together to provide a desired function.

Determination of the Beat Pattern Problem

The inventors have determined that the problem of beat patterns is related to the modulation results of the video pixel frequency and interference from other system frequencies used by different subsystems within an integrated video display system. More specifically, an integrated video display system contains many subsystem blocks and each block may use a different clock frequency. Due to implementation constraints, clock interferences from nearby blocks are unavoidable. In a video display sub-system, these interferences alter slightly the width of the pulse created by the video pixel clock, which produces beat patterns.

The inventors have determined that one display mode suffering from the problem is the 1280×1024×75 Hz mode in certain video display systems. When the video data stream contains a "1010" pattern, its frequency beats with the second harmonic frequency of a 33 MHz PCI cock signal (66 MHz), thereby producing beat patterns. The "1010" pattern should only show stable fine vertical lines on the display screen without any beat patterns. These lines and the gaps between them are so fine that the viewer should see a half intensity solid color display. However, the beat components change the intensity of some displayed regions causing bands appear. The combined effect of the RGB video outputs also changes the color hue of these bands. If the beat frequency has a non-integer relationship with half of the horizontal scanning frequency, then the bands move. Adjusting the frequency relationship can change the direction of the movement. The intensity difference between the bright and the dim levels of the band patterns can be as small as a couple percent. This intensity difference is caused by width modulation of the "1010" video data pulses. Although the magnitude is minor, it degrades the video quality significantly. The "1010" video pulses should have a typical pulse width of 7.4 nSec (135 MHz pixel frequency). A width modulation of ±100 pSec produces noticeable bands to the viewer. Within the time duration of a band, all pulse widths are modulated in one direction, either positively or negatively. If the beat frequency is much lower than the pixel frequency, then there are many (e.g., <100) consecutive pulses modulated in that direction.

What the inventors found is that in many video circuit designs, the clock signal driving the video RGB Digital-to-Analog Converters (DACs) requires many buffers and connecting wires from the clock source to the destination DACs. This long signal path can possibly pick up unwanted interferences from nearby subsystems. The unwanted interferences can change slicing levels of the clocks buffers, which causes non-uniform clock periods. This distorted clock driving the DAC produces width modulated video pulses. The interferences are sometimes coupled through the supply and ground connections. Moreover, the DAC switching circuit also contributes to the pulse width modulation. As mentioned previously, a minor ±100 pSec clock modulation results in noticeable bands to the viewer. In practice, a small amplitude of ±100 mV interfering signal adding to the clock input node produces a similar effect. The external clock input must slew faster than 1 nSec/Volt otherwise the bands would be even more noticeable (more than ±100 pSec pulse width modulation). The problem has been seen when the interfering signal is either a square or sine wave.

After making this determination, the inventors solved the problem by using a "clean" local pixel clock to re-clock the final stage of the video data path to the RGB DACs. By re-clocking the video data at the final stage, the interfering influence of other system clocks is removed, resulting in a beat-pattern free data signal. The final stage can be an integral design of the video DACs. This solution also allows more design freedom, such as higher jitter tolerance budget for the entire clock distribution system and increased distance between the video data source and the RGB DACs. This implies a remote connection between the video data source and the DACs.

Illustrative Re-Clocking Circuit

One embodiment of the invention employs re-clocking flip-flops to re-time the input signals feeding the video Red/Green/Blue Digital-to-Analog converters (RGB DACs) such that data edge jitters due to interference are removed. This scheme addresses the problem directly, and the resulting picture quality is free of beat patterns.

FIG. 1 illustrates a schematic diagram of an electronic circuit 100 for connecting a video data source 103 to a video DAC circuit 105. An external clock reference 107 provides a signal to a local clock generator 109, which in turn outputs a pixel clock signal 111 via a clock buffer 113. Clock logic circuitry 115 processes the pixel clock signal 111 and provides a processed pixel clock signal 117 to the video DAC circuit 105 as well as a video data source 119. The video data source 119 provides a video data signal 121 to the video DAC circuit 105 in syn with the processed pixel clock 117.

The video data source 103 can be either remote or local to the video DAC circuit 105. The pixel clock signal 111 and the processed pixel clock signal 117 are sensitive paths to interferences. If there are more circuitries extending these signal paths, either inside or outside the block boundaries, those are also sensitive to interferences. If the connection between the video data source 103 and the video DAC circuit 105 is short, interference by other system clocks will be insignificant to cause beat patterns. On the other hand, a long connection is likely to result in beat patterns. The video data signal 121 is less sensitive, and proper arrangement for setup and hold times is normally sufficient.

The first operation mode (Scheme A) occurs when the scheme select switch 123 is in the "A" position. In that position, the processed pixel clock signal 117 is coupled to a first D flip-flop 125, a second D flip-flop 127, and to the RGB DAC 129. It will be appreciated that although only a single flip-flop and DAC may be shown in FIG. 1, there may in fact be several D flip-flops and DACs, one per data line. In this configuration, the processed pixel clock 117 is used to latch the video data signal 121 through to the RGB DAC 129.

Scheme A is a conventional non re-clocking scheme where the input data flip-flops and the RGB DAC timings are all driven by the video data source 103 through the processed pixel clock signal 117. Thus, the RGB DAC 129 receives its clock input through the clock buffers and connections. This scheme does not eliminate beat patterns because there is no re-clocking function.

The second operation mode (Scheme B) occurs when the scheme select switch 123 is in the "B" position. In that position, the processed pixel clock signal 117 is coupled only to the first flip-flop 125. The local clock generator 109 is coupled, via a clock phase selector 131, to the clock inputs of the second flip-flop 127 and the RGB DAC 129. In this configuration, the processed pixel clock 117 is used to latch the video data signal 121 into the first flip-flop 125, but the local clock generator 109 is used for timing the second flip-flop 127 and the DAC 129.

Scheme B is the basic re-clocking scheme such that the processed pixel clock signal 117 becomes a buffered version (same frequency) of the pixel clock signal 111. As just mentioned, the clock feeding the second flip-flop 127 and the RGB DAC 129 is taken from the local clock generator 109. Because the connection is short and local, interference from other system clock sources should be an insignificant cause of beat patterns. The second flip-flop 127, which again may contain several flip-flops, is re-clocked with the local "clean" timing, thus the output should be free of beat patterns.

The third operation mode (Scheme C) occurs when the scheme selected switch 123 is in the "C" position. In that position, the processed pixel clock 117 is coupled to the D input of a third flip-flop 133, the Q output of which is coupled to the clock inputs of the second flip-flop 127 and the RGB DAC 129. However, the clock input of the third flip-flop 133 is fed by a clock signal 135 from the clock phase selector 131. In this configuration, the processed pixel clock 117 is used to latch the video data signal 121 into the first flip-flop 125, but the local clock generator 109 is used for timing the second flip-flop 127 and the DAC 129.

Scheme C is applicable to specific designs where the processed pixel clock signal 117 is not a buffered version (e.g., not the same frequency) of the pixel clock signal 111. For some designs and under some video modes, there are some circuit functions, such as a divide-by-2 function, employed between the pixel clock signal 111 and the processed pixel clock signal 117. These types of circuits cannot use Scheme B for re-clocking because the clock frequencies are different. Hence, Scheme C employs an additional D-flip-flop 133 which takes a different (e.g., 2x) frequency clock from the local clock generator to re-time the edges of the processed pixel clock signal 117. The output of the third flip-flop 133 is then used to perform the normal re-clocking function as described in Scheme B.

The clock phase selector 131 selects the proper clock phase for its two clock outputs so that the appropriate flip-flops (127 and 133) operate with proper setup and hold times. There are several options for implementing the clock phase selector 131. For instance, if the delay of the total clock path is predictable and within a small range, then a simple fixed value delay line can be implemented for the phase selector. This option has the advantage of being low cost. Alternatively, a coarse phase selector could be used to compare two local pixels clocks, 0 and 180 degrees, and pick the one that provides the best setup and hold time margins for the resynchronization flip-flops. This method may be preferred for most applications. Yet another alternative is to use a phase-locked-loop (PLL) to develop the correct timing for the resynchronization flip-flops, resulting in the best setup and hold time margins. The PLL could be a simple phase-only tracking circuit. This approach offers fine phase steps than the coarse phase selector.

Figure 2:
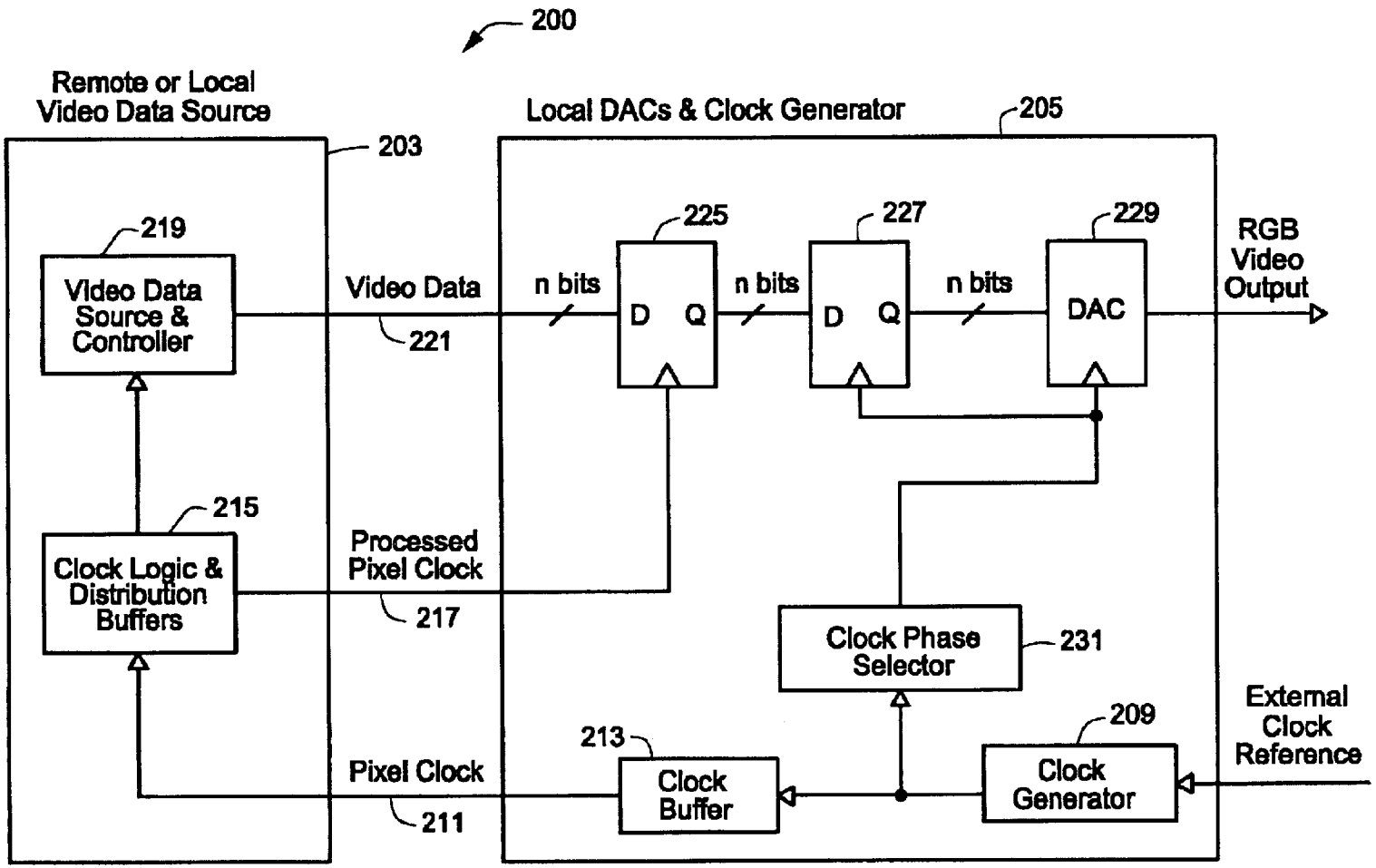
FIG. 2 shows another schematic diagram of an alternative electronic circuit including re-clocking with improved beat pattern characteristics in accordance with the present invention.

FIG. 2 is another schematic diagram of an alternative electronic circuit 200 for connecting a video data source to a video DAC. The alternative circuit 200 includes only those components used in the re-clocking scheme described above for addressing the problem of beat patterns. An external clock reference 207 provides a signal to a local clock generator 209, which in turn outputs a pixel clock signal 211 via a clock buffer 213. Clock logic circuitry 215 processes the pixel clock signal 211 and provides a processed pixel clock signal 217 to the video DAC circuit 205 as well as a video data source 219. The video data source 219 provides a video data signal 211 to the video DAC circuit 205 in sync with the processed pixel clock 217.

The video data source 203 can be either remote or local to the video DAC circuit 205. The pixel clock signal 211 and the processed pixel clock signal 217 are sensitive paths to interferences. If there are more circuits extending these signal paths, either inside or outside the block boundaries, those are also sensitive to interferences. For these reasons, the circuit 200 would be susceptible to beat patterns in the absence of the teachings of the present invention.

In this embodiment, the processed pixel clock signal 217 is coupled only to a first flip-flop 225 for latching the video data signal 221. The local clock generator 209 is coupled, via a clock phase selector 231, to the clock inputs of a second flip-flop 227 and an RGB DAC 229. In this configuration, the processed pixel clock 217 is used to clock the first flip-flop 225, but the local clock generator 209 is used for timing the second flip-flop 227 and the DAC 229. In this configuration, the processed pixel clock signal 217 is a buffered version (same frequency) of the pixel clock signal 211. As just mentioned, the clock feeding the second flip-flop 227 and the RGB DAC 229 is taken from the local clock generator 209. Because the connection is short and local, interference from the other system clock sources should be insignificant. The second flip-flop 227, which again may contain several flip-flops, is re-clocked with the local "clean" timing, thus the output should be free of beat patterns. Note that the circuit illustrated in FIG. 2 differs from that illustrated in FIG. 1 in that the alternative clocking schemes are not present. In FIG. 2, the circuit 200 reflects only the re-clocking scheme that is used to avoid beat patterns.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A method for clocking video data to reduce beat patterns, comprising:

receiving a video data signal having a predetermined pixel frequency based on an external clock reference, the video data signal being provided by video data signal circuitry; and providing a local clock signal to re-clock the video data signal data first stage of a video path between the video data signal circuitry and output circuitry, the local clock signal being based on the external clock reference, thereby removing interfering influence of other clock signals on the predetermined pixel frequency.

2. The method of claim 1, wherein the video data signal is received within an integrated video display system.

3. The method of claim 1, wherein the video signal data signal is generated within an integrated video display system.

4. The method of claim 1, wherein the output circuitry comprises a digital-to-analog converter subcircuit.

5. The method of claim 4, wherein providing the local clock signal comprises latching the video data signal with at least one latching subcircuit clocked by the local clock signal.

6. The method of claim 5, wherein the latching subcircuit comprises at least one flip-flop configured to latch the video data signal through to the output circuitry, the flip-flop being clocked by the local clock signal.

7. An integral video display system for providing a video signal having reduced beat patterns, comprising:

a video data circuit coupled to an output circuit through a latching circuit, the video data circuit being configured to provide a video data signal based on a pixel frequency, the pixel frequency being based on an external clock reference, the latching circuit being at a final stage of a video path between the video data signal circuit and the output circuit; and a re-clocking circuit coupled to the latching circuit, re-clocking circuit being on figured to provide a local clock signal for re-clocking the video data signal through the latching circuit, wherein re-clocking the circuit is based on the external clock reference, and the video data signal is provided to the output circuit based on the local clock signal.

8. The integrated video display system of claim 7, wherein the latching circuit comprises at least one flip-flop configured to latch the video data signal through to the output circuit, the flip-flop being clocked by the local clock signal.

9. The integrated video display system of claim 8, wherein the flip-flop is part of a final stage for the video data signal prior to being coupled to the output circuit.

10. The integrated video display system of claim 7, wherein the output circuit comprises a digital-to-analog converter subcircuit.

11. The integrated video display system of claim 7, further comprising a selection circuit for selectively switching between conventionally clocking the video data signal based on the pixel frequency and re-clocking the video data signal based on the local clock signal.

12. An integrated video display system for providing a video signal having reduced beat patterns, comprising:

a video data source based on a predetermined pixel frequency;

an output circuit;

a conventional clocking circuit including a clock signal based on the predetermined pixel frequency;

a re-clocking circuit having a frequency based on a clock signal provided by a local clock generator; and a select switch for selectively coupling the video data source to the output circuit based on either the conventional clocking circuit or the re-clocking circuit, wherein interfering the influence of other clock signals on the predetermined pixel frequency is removed if the re-clocking circuit is coupled a final stage of a video path between the video data source and the output circuit.

13. The integrated video display system of claim 12, wherein the predetermined pixel frequency is based on an external clock reference and wherein the local clock generator is based on the external clock reference.

14. The integrated video display system of claim 13, wherein the local clock generator provides a pixel clock signal to the video data source on which to base the predetermined pixel frequency.

15. The integrated video display system of claim 12, wherein the output circuit comprises a digital-to-analog converter subcircuit.

16. The integrated video display system of claim 12, wherein the re-clocking circuit comprises at least one latching subcircuit clocked by the local clock generator.

17. The integrated video display system of claim 16, wherein the latching subcircuit comprises at least one flip-flop configured to latch the video data source through to the output circuitry, the flip-flop being blocked by the local clock signal.

18. The integrated video display system of claim 17, wherein the latching subcircuit is coupled to the video data source and the output circuitry, and wherein the output circuitry comprises a digital-to-analog converter subcircuit.

19. The integrated video display system of claim 18, wherein the latching subcircuit is the final stage of a video data path between the video data source and the output circuitry.

* * * * *

UNITED STATES PATENT AND TRADEMARK OFFICE

CERTIFICATE OF CORRECTION

PATENT NO. : 6,873,318 B1
DATED : March 29, 2005
INVENTOR(S) : Wong

It is certified that error appears in the above-identified patent and that said Letters Patent is hereby corrected as shown below:

Title page,
Item [57], ABSTRACT,
Line 9, delete “flips-flops” and insert -- flip-flops --.

Column 1,
Line 42, delete “interfacing” and insert -- interfering --.
Line 42, delete “ether” and insert -- either --.

Column 2,
Line 2, delete “Afterwords” and insert -- Afterwards --.
Line 5, delete “embodiments” and insert -- embodiment --.

Column 3,
Line 25, delete “<100” and insert -- >100 --.
Line 33, delete “clocks” and insert -- clock --.

Column 4,
Line 8, delete “syn” and insert -- sync --.
Line 61, delete “selected” and insert -- select --.

Column 5,
Line 27, delete “pixels” and insert -- pixel --.
Line 32, delete “resynchronization” and insert -- re-synchronization --.
Line 34, delete “fine” and insert -- finer --.
Line 47, delete “211” and insert -- 221 --.

Column 6,
Line 3, after “from” delete “the”.
Line 25, after “signal” delete “data first stage” and insert -- at a final stage --.
Line 32, after “video” delete “signal”.
Line 45, delete “integral” and insert -- integrated --,
Line 55, insert -- the -- before “re-clocking”.
Line 55, delete “on figured” and insert -- configured --.

Column 7,
Line 22, after “interfering” delete “the”.

UNITED STATES PATENT AND TRADEMARK OFFICE

CERTIFICATE OF CORRECTION

PATENT NO. : 6,873,318 B1
DATED : March 29, 2005
INVENTOR(S) : Wong

It is certified that error appears in the above-identified patent and that said Letters Patent is hereby corrected as shown below:

Column 8,
Line 17, delete “blocked” and insert -- clocked --.

Signed and Sealed this

Twelfth Day of July, 2005

JON W. DUDAS
*Director of the United States Patent and Trademark Office*